United States Patent [19]

Becker et al.

[11] 4,337,704

[45] Jul. 6, 1982

[54] TURBULENT-WATER WAY

[75] Inventors: Klaus Becker; Jurgen Cittrich; Karl E. Kaufmann, all of Wetter, Fed. Rep. of Germany

[73] Assignee: Mannesmann DeMag A.G., Duisburg, Fed. Rep. of Germany

[21] Appl. No.: 153,895

[22] Filed: May 28, 1980

[30] Foreign Application Priority Data

May 28, 1979 [DE] Fed. Rep. of Germany ..... 2921629

[51] Int. Cl.[3] ..... A63G 21/18

[52] U.S. Cl. ..... 104/70; 52/169.7; 272/56.5 R; 405/1

[58] Field of Search ..... 405/1; 52/169.7, 169.8; 272/56.5; 104/70–73

[56] References Cited

U.S. PATENT DOCUMENTS 3,853,067 12/1974 Bacon ..... 104/70

4,194,733 3/1980 Whitehouse, Jr. ..... 104/70

OTHER PUBLICATIONS

Sanitare Technik in Bild—Oct. 1956.

*Primary Examiner*—Richard A. Bertsch

*Attorney, Agent, or Firm*—Mandeville and Schweitzer

[57] ABSTRACT

A turbulent waterway, having boats guided in a trough made from bargrating, individual plates of which are connected with each other, the side of the trough being covered with a dense synthetic plastic film.

10 Claims, 3 Drawing Figures

TURBULENT-WATER WAY

BACKGROUND AND SUMMARY OF THE INVENTION

The invention concerns a turbulent-water way with boats guided in a trough.

Turbulent-water ways are arranged in recreational installations and may end in a lower water basin from which the boats are transported in a tow track up-hill to the beginning of the trough. If there is no natural water current, for instance a river, the water necessary for the turbulent-water way must be pumped from the lower water basin to the beginning of the trough, where there should be preferably also a water basin. The edge of the trough must be stable and smooth, as otherwise the boats would be damaged. Heretofore, the trough was made very elaborately of concrete, whereby the premises was disfigured by the building vehicles. During frosts and ground sagging the concrete trough ruptures and with it loss of water.

It is the object of the invention, to create a turbulent-water way which is durable and economical. The object is achieved when the trough is made of bar grates, the individual plates of which are connected with each other and which are sealed with a dense synthetic plastic film on the inside of the trough. The bar grates lend the trough a stable cross section. The different intervals between the grates make it possible to adapt the trough to the ground. In case of ground sagging, the elastic synthetic plastic film gives water tightness.

The sidewalls of the trough are inclined at the angle of the embankment, so that the earth does not have to be specially treated. The bar grates are grouted with mortar at the bottom of the trough, and on the inclined side walls of the trough sheets of metal are arranged between the synthetic film and the bar grates. The sheets of metal extend above the bordering earth and have upwardly erected water edges. The pressure of the water keeps the sheets of metal with their water edges in the described position on the earth. The trough may have a center guide for two control surfaces of the boats which are laterally spaced from and embrace the center guide. The center guide prevents the bumping of the sides of the boats on the side walls of the trough and prevent contusions of hands between the boat wall and the wall of the trough. The center guide may be a flat section or a pipe and may be supported on top of plates at the bottom of the trough. To that end, the plate is fixed in bushings with bolts, which bushings are connected with the bar grates. The synthetic plastic film is pierced by the bolts and at the penetrations is sealed with a paste or is sealed with a pasted-over piece of film.

An exemplary embodiment of the invention is illustrated in the drawings and explained below.

DETAILED DESCRIPTION OF THE INVENTION

Figure 1:
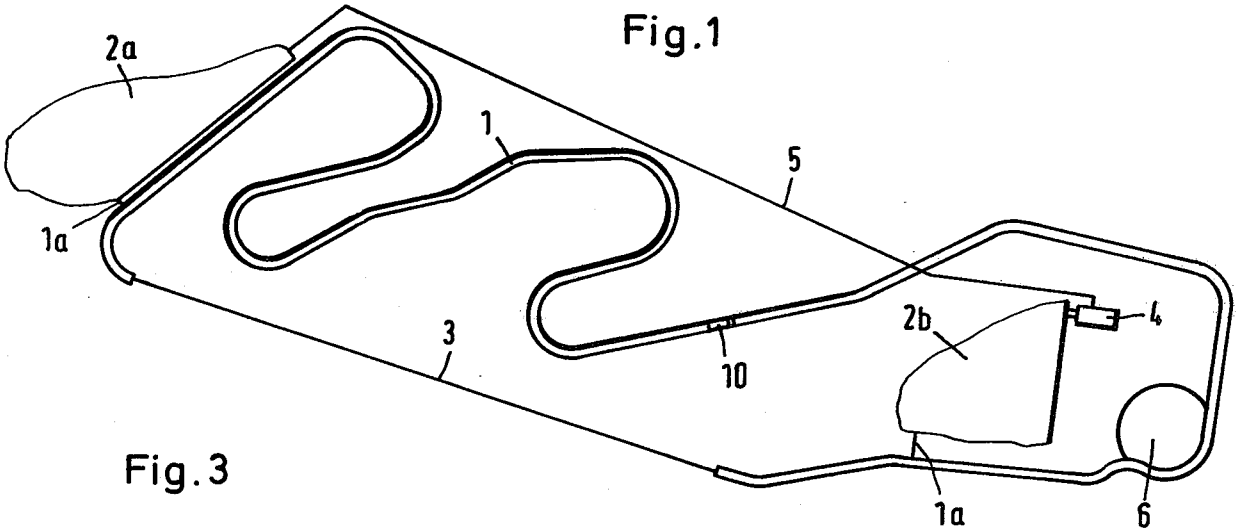
FIG. 1 is a turbulent-water way positioned in the ground.

FIG. 1 shows a turbulent-water way with a trough 1 for boats 10. The trough has an incline of 0.5 to 2% and connects the upper water basin 2*a* with the lower water basin 2*b*, from which leads a carrying conveyor 3 for upward transport of the boats 10 to the upper water basin 2*a*. The water flowing through the trough is pumped by a pump 4 from the lower water basin 2*b* through a water conduit 5 to the upper water basin 2*a*. The trough 1 is connected with the two water basins 2 via the connecting lines 1*a* for the taking in and carrying away of the flowing water. In the proximity of the lower water basin 2*b* the trough 1 is guided along a turntable to which the boats 10 are fastened during entering and exiting. The boats need therefore not be stopped in the current.

Figure 2:
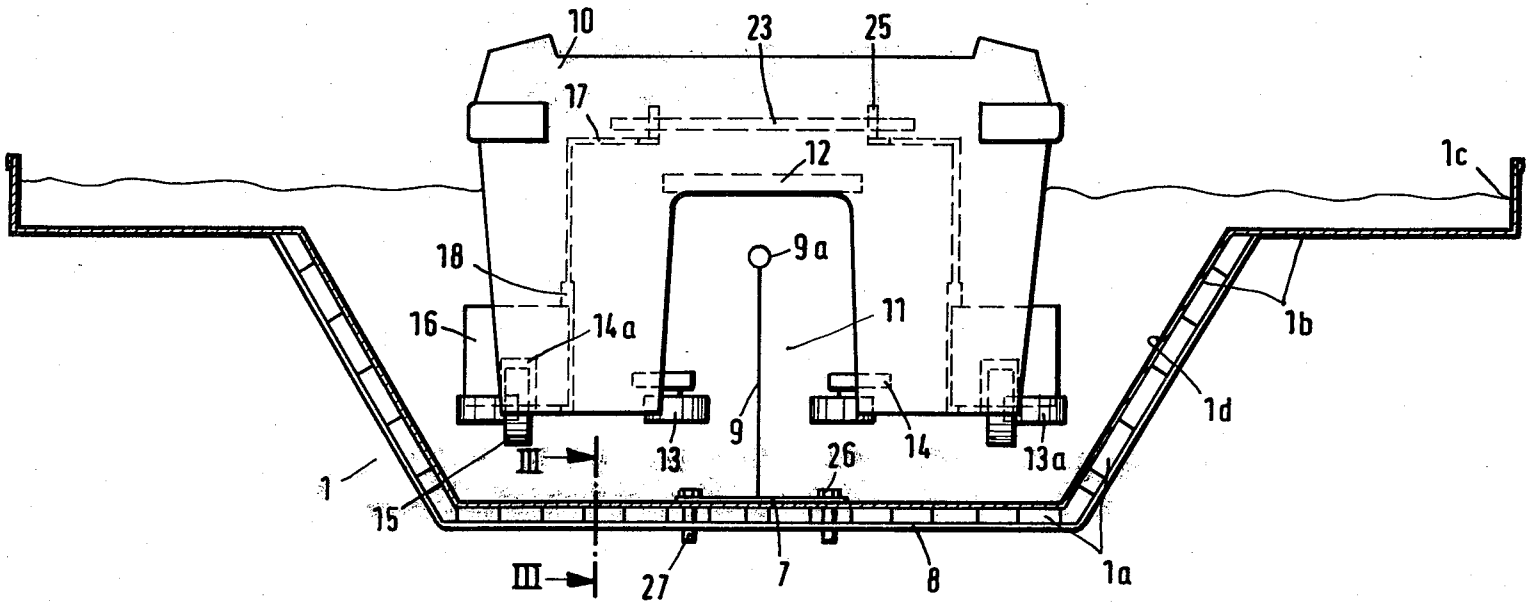
FIG. 2 is a cross section through the trough on a larger scale.

FIG. 2 shows a cross section through the trough 1 with its water level and a rear view of boat 10 with a seating bench 12 at the recess 11 at the sides of which are arranged in bearing blocks 14 guiding rollers 13 in the front and rear parts of the boat 10. Further guiding rollers 13*a* are positioned at the outer wall of the boat. Between the guiding rollers 13 and 13*a* respectively and the center guide 9, and, the trough wall, respectively, there is a gap to make side movements of the boat in the trough possible.

Underneath the boat are rollers 15 in bearing blocks 14*a* which carry the boat in shallow waters and prevent the boat from rolling too much.

On the bottom and at the inclined sides the trough consists of commericially available bar grates 1*a*. This is grouted with mortar at the bottom, and at the inclined sides is covered with a piece of sheet metal 1*b* which forms a cover near the trough for the earth. The cover has a water edge 1*c* and optically widens the trough. The trough is covered inside with a synthetic film 1*d*.

Figure 3:
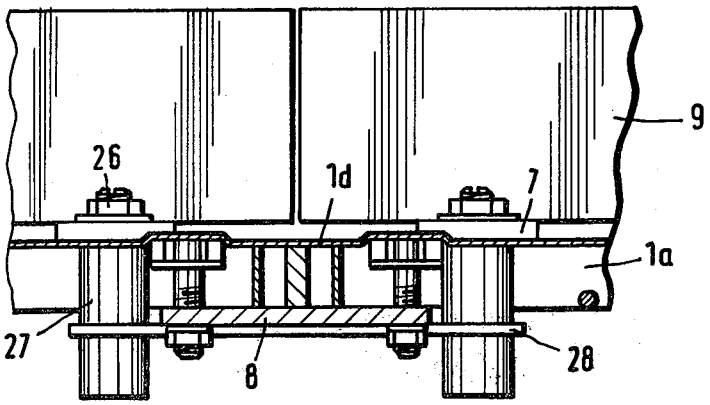
FIG. 3 is the section III—III through FIG. 2 on a larger scale.

The above-mentioned center guide 9 is a sheet-metal strip with an upper pipe 9*a* and is carried by plates 7, which are connected via bolts 26 with bushings 27 present in the bar grates. The bushings are passed underneath the bar grates 1*a* through lashings 28. The bar grates 1*a* are connected with each other at the butt joints via T-profiles 8, as shown in FIG. 3.

We claim:

1. A trough for a turbulent waterway comprising:

(a) a bottom surface constructed of bar grating;

(b) two side walls constructed of bar grating;

(c) said side walls being loosely connected to said bottom surface and extending upwardly therefrom; and (d) said bottom surface and said side walls having an overlying synthetic film for providing a watertight environment.

2. A trough as claimed in claim 1, wherein:

(a) said side walls are inclined with respect to said bottom surface.

3. A trough as claimed in claim 1, wherein:

(a) said bottom surface and/or at least one of said side walls are constructed of at least two bar grates which are themselves loosely connected to one another.

4. A trough as claimed in claim 1, wherein:

(a) said side walls are connected to said bottom surface by mortar.

5. A trough as claimed in claim 1, wherein:

(a) sheet metal is provided to said side walls between said bar grating and said synthetic film.

6. A trough as claimed in claim 5, wherein:

(a) said sheet metal extends upwardly from said bottom surface, and above said side walls to thereby provide upwardly extending water retaining edges.

7. A trough as claimed in claim 1, wherein:

(a) said bottom surface is provided with a center guide member which is adapted to control lateral displacement of a boat riding in said trough; and (b) said guide member is positioned between two control surfaces of said boat.

8. A trough as claimed in claim 7, wherein:

(a) said center guide member is flat.

9. A trough as claimed in claim 8, wherein:

(a) said center guide member is supported on said bottom surface.

10. A trough as claimed in claim 9, wherein:

(a) said center guide member is secured to said bottom surface by bolts; and (b) said bolts pass through integral bushings of said bar grating of said bottom surface.

* * * * *